US010682024B1

(12) United States Patent
Dorn

(10) Patent No.: US 10,682,024 B1
(45) Date of Patent: Jun. 16, 2020

(54) TOILET ROLL EXTENDER

(71) Applicant: LeRoy Edmond Dorn, Raleigh, NC (US)

(72) Inventor: LeRoy Edmond Dorn, Raleigh, NC (US)

( * ) Notice: Subject to any disclaimer, the term of this patent is extended or adjusted under 35 U.S.C. 154(b) by 0 days.

(21) Appl. No.: 16/602,943

(22) Filed: Dec. 30, 2019

Related U.S. Application Data

(63) Continuation-in-part of application No. 15/732,635, filed on Jan. 26, 2018.

(51) Int. Cl.
*A47K 10/40* (2006.01)
*A47K 10/38* (2006.01)

(52) U.S. Cl.
CPC ..... *A47K 10/40* (2013.01); *A47K 10/3836* (2013.01)

(58) Field of Classification Search
CPC ..... A47K 10/40; A47K 2010/3253; A47K 2010/3863; A47K 10/22; A47K 10/405; A47K 20/32; A47K 10/3836; A47K 10/3809
See application file for complete search history.

(56) References Cited

U.S. PATENT DOCUMENTS 5,871,170 A * 2/1999 Morales ..... A47K 10/40 242/592
6,378,800 B1 * 4/2002 Apichom ..... A47K 10/40 242/560
6,945,493 B1 * 9/2005 Gottesman ..... A47K 10/38 242/560.2
2018/0125308 A1 * 5/2018 Cuenca ..... A47K 10/22
2018/0333012 A1 * 11/2018 Cuenca ..... A47K 10/22

FOREIGN PATENT DOCUMENTS

JP 2006102192 A * 4/2006

* cited by examiner

*Primary Examiner* — Daniel J Colilla

(57) ABSTRACT

A toilet roll extender replaces the compression rod of an existing toilet paper dispenser and relocates the toilet paper to a more reachable position.

1 Claim, 2 Drawing Sheets

TOILET ROLL EXTENDER

TECHNOLOGY FIELD

The technology filed is bathroom fixtures. In particular, the technology field related to toilet roll dispenser devices.

BACKGROUND OF THE INVENTION

When an existing bathroom toilet roll dispenser is mounted in a location too far behind a person seated on the toilet, thus making the toilet paper difficult to reach. It would be desirable to have a means of relocating the toilet paper without relocating the dispenser. Such a means would ideally utilize the existing dispenser, but functionally extend the toilet paper cylinder forward, putting the toilet paper in a more reachable location. The present toilet roll extender addresses this issue.

BRIEF SUMMARY OF THE INVENTION

A toilet roll extender uses an existing toilet roll dispenser and repositions the toilet paper to a more reachable location. Other features and advantage of this device will be apparent to those familiar with toilet roll dispensers from a careful reading of the Detailed Description accompanied by the drawings.

BRIEF DESCRIPTION OF THE DRAWINGS

In the figures.

DETAILED DESCRIPTION

Figure 1:
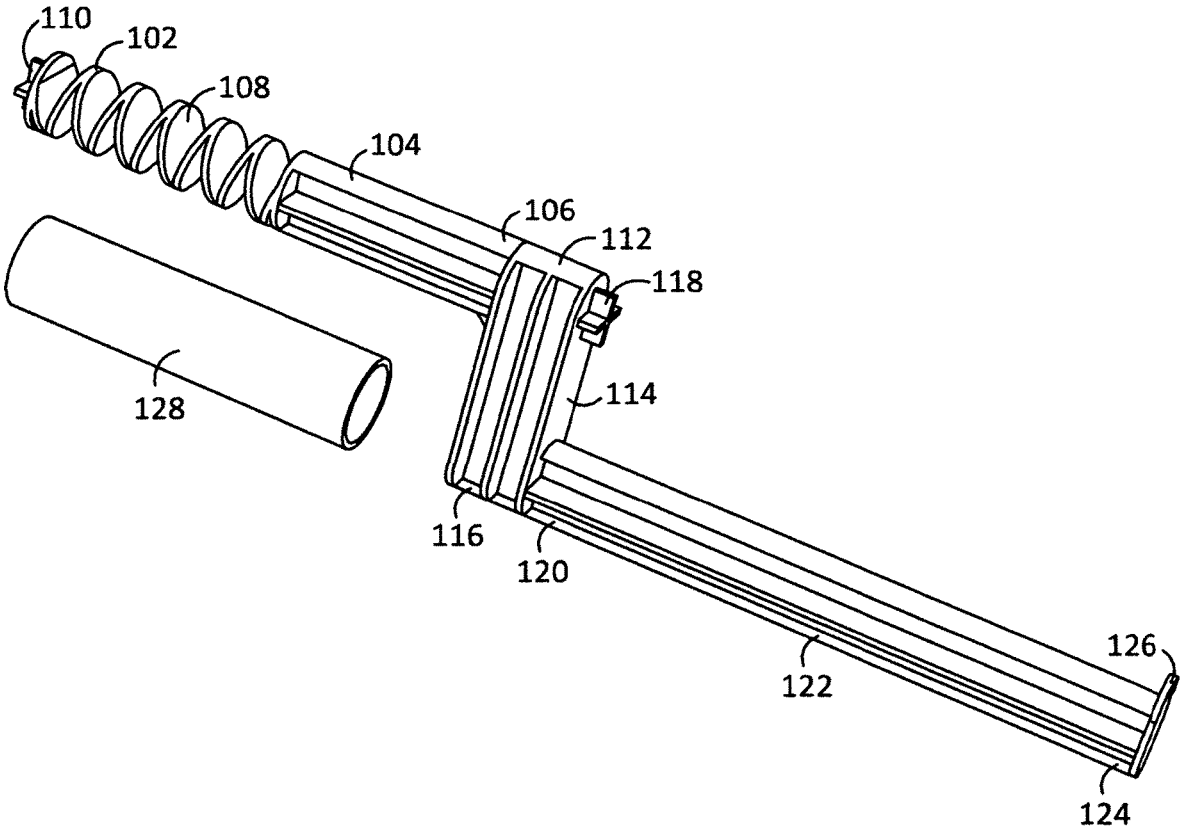
FIG. 1 is a perspective view of a simple embodiment of the present toilet roll extender having two components: 1) an inner rod rigidly fixed to an offset rigidly fixed to an extension rod, inner rod having an integral spring; and 2) an external sleeve for use in covering and stabilizing inner rod and spring.

FIG. 1 is a perspective view of a simple embodiment of the present toilet roll extender having two components: 1) an inner rod rigidly fixed to an offset rigidly fixed to an extension rod, inner rod having an integral spring; and 2) an external sleeve for use in covering and stabilizing the inner rod and spring.

This embodiment comprises an inner rod 104 having a first end 102 and a second end 106, first end 104 having an integral spring 108 having a tab 110 for use in pivotally mounting toilet roll extender on an existing toilet paper dispenser housing (not shown), second end 106 rigidly fixed to the first end 112 of an offset 114 having first end 112 and a second end 116, first end 112 having a second tab 118 for use in pivotally mounting toilet roll extender on existing toilet paper dispenser housing (not shown), second end 116 of offset 114 rigidly fixed to the first end 120 of an extension rod 122 having first end 120 and a second end 124 having a positioning stop 126 for use in preventing toilet paper (not shown) from falling off second end 124 of extension rod 122. An outer sleeve 128 is for use in covering and stabilizing inner rod 104 and integral spring 108.

Figure 2:
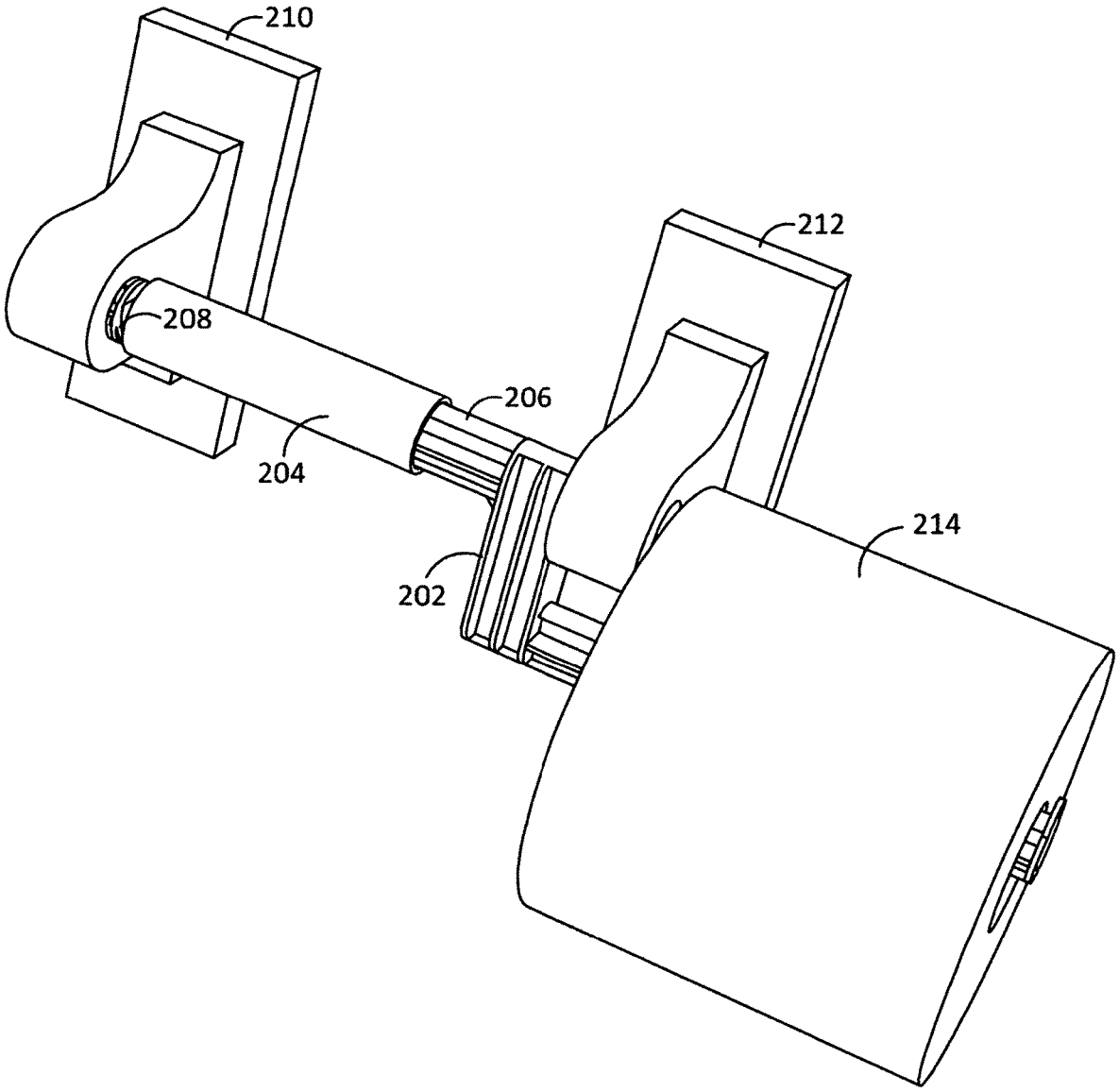
FIG. 2 is a perspective view of a similar embodiment of the present toilet roll extender with external sleeve mounted on an existing toilet paper dispenser housing and toilet paper mounted on toilet roll extender in an extended forward position.

FIG. 2 is a perspective view of a similar embodiment of the present toilet roll extender 202 with the external sleeve 204 covering and stabilizing the inner rod 206 and integral spring 208, toilet roll extender 202 mounted on an existing toilet paper dispenser housing 210, 212 and toilet paper 214 mounted on toilet roll extender 202 in an extended forward position.

It will be apparent to those knowledgeable about toilet paper dispensers that many modifications and substitutions can be made to the foregoing description of embodiments without departing from the scope and spirit of the present disclosure which is defined by the appended claims.

What is claimed is:

1. A toilet roll extender, comprising:

(a) an inner rod having a first end and a second end, said first end having an integral spring having a tab, said second end rigidly fixed to the first end of an offset having said first end and a second end, said first end of said offset having a second tab, said tab and said second tab for use in mounting said toilet roll extender on an existing toilet paper dispenser, said second end of said offset rigidly fixed to the first end of an extension rod having said first end and a second end, said second end of said extension rod having a positioning stop; and (b) an outer sleeve for use in covering and stabilizing said inner rod and said integral spring.

* * * * *